United States Patent [19]

Ritzl et al.

[11] Patent Number: 4,580,502

[45] Date of Patent: Apr. 8, 1986

[54] DEVICE FOR UNLOADING A CONTAINER FOR BULK MATERIALS

[75] Inventors: Antal Ritzl, Zurich; Jürg Zehnder, Uitikon, both of Switzerland

[73] Assignee: Swiss Aluminium Ltd., Chippis, Switzerland

[21] Appl. No.: 530,923

[22] Filed: Sep. 12, 1983

[30] Foreign Application Priority Data

Sep. 16, 1982 [CH] Switzerland ..... 5477/82

[51] Int. Cl.[4] ..... B61D 7/04; B61D 7/18; B61D 7/28; E05C 19/04

[52] U.S. Cl. ..... 105/240; 105/251; 105/283; 105/284; 105/290; 105/299; 105/308 C; 222/503; 292/75; 298/34; 298/37

[58] Field of Search ..... 49/109–112; 105/250, 251, 257, 280, 283, 284, 286, 288–290, 299, 306, 308 R, 308 C, 310, 240; 222/482, 503; 292/74, 75, DIG. 57; 298/34, 37, 38

[56] References Cited

U.S. PATENT DOCUMENTS

| | | | |
|---|---|---|---|
| 2,630,767 | 3/1953 | Dorey | 105/251 |
| 2,769,403 | 11/1956 | Cox | 105/288 |
| 3,161,147 | 12/1964 | Sapp, Sr. | 105/290 X |
| 3,167,026 | 1/1965 | Kemp | 105/250 |
| 3,187,684 | 6/1965 | Ortner | 105/290 X |
| 3,343,725 | 9/1967 | Cannon | 105/299 X |
| 3,581,672 | 6/1971 | Aquino | 105/299 X |
| 3,626,865 | 12/1971 | Aquino et al. | 105/251 X |
| 4,194,450 | 3/1980 | Miller | 105/299 X |
| 4,418,949 | 12/1983 | Horgan, Jr. | 292/DIG. 57 X |

FOREIGN PATENT DOCUMENTS

| | | | |
|---|---|---|---|
| 406500 | 12/1924 | Fed. Rep. of Germany | 105/257 |

*Primary Examiner*—Robert B. Reeves
*Assistant Examiner*—David F. Hubbuch
*Attorney, Agent, or Firm*—Bachman & LaPointe

[57] ABSTRACT

A device for unloading a container used for bulk materials is such that a container floor is made up at least in part of flaps which can be tilted or swung out away from the interior. To this end at least two flaps are connected via a ridging beam or axle which runs through the interior of the container above a rotatable shaft. The rotational movement of the shaft is transmitted to the flaps to actuate same. The shaft features on opposite sides and transverse to its longitudinal axis first and second flange pairs, the former accommodating an elbow lever with the help of a push-fit bolt, and the latter a lever with the help of a bolt. The elbow lever and the lever are hinged to the flaps respectively. Further, connected to the flaps is a lock which joins up via bolts with the elbow lever or the lever, and in the closed position engages on a latching device.

4 Claims, 9 Drawing Figures

DEVICE FOR UNLOADING A CONTAINER FOR BULK MATERIALS

BACKGROUND OF THE INVENTION

The invention relates to a device for unloading a container used for transporting bulk goods, wherein the floor of the container is made up at least in part of flaps which can be tilted outwards from the interior of the container.

The unloading device is intended for use in particular in a railway hopper truck having at the longitudinal axis a center sill with foot projecting out approximately perpendicularly on each side, and sidewalls with reinforcing section at the lower edge.

Known, for example from the U.S. Pat. No. 3,949,681, is an unloading device comprising two flaps which form the floor of the truck and which touch approximately at the longitudinal axis of the truck when in the closed position. The flaps are opened outwards via a hydraulic drive for unloading purposes. In this design, however, problems arise as the whole load of the truck contents rests on the flaps, in particular close to the place where both flaps touch. Consequently, the flaps have to be held in place by a special means of suspension. Furthermore, there is no central, longitudinal beam to mount the coupling facilities on, or to improve the distribution of pressure and the stability of the truck.

Other railway trucks as, for example, shown in the German patent No. 23 58 079 are sub-divided into individual silos with the floor formed by flaps lying transverse to the long axis of the truck. Each flap is provided with its own power means so that each silo can be emptied individually at will. Apart from the fact that the central longitudinal beam is also missing here, this system is very expensive due to the individual power means for each flap.

The U.S. Pat. No. 3,805,708 shows a railway truck with longitudinal beam and unloading device parallel to the longitudinal axis. This unloading facility comprises two flaps, one of which hinges on the longitudinal beam, the other on the bottom of the sidewall. In the closed position the flaps form a funnel and are locked at the place of contact. A disadvantage here is that the total pressure from the truck contents acts on the flaps and especially on the locking facility which in turn does not feature a direct connection to a rigid element of the truck. Furthermore, some parts of the power means for the flaps are of necessity inside the truck, and are therefore exposed to possible damage by the contents during loading. Also, this arrangement of the flaps only permits unloading onto the rails lying approximately below the contact point of both flaps. This is undesireable as the wheels of the truck have to run over the residual, unloaded material as the truck is pulled away.

Revealed in the Australian patent No. 476 860 is an unloading device for a railway hopper truck with center sill having a flap on each side of the center sill and hinged to the corresponding sidewall; the flaps close onto a lower edge of the center sill or a lower edge of a run-off surface covering the center sill. The unloading device is operated hydraulically, the whole of the drive mechanism being situated inside the truck and the hydraulic piston being mounted on the center sill above the run-off surface. Due to the direct contact with the contents the drive mechanism is subjected to considerable wear. Furthermore, this arrangement only permits unloading towards the center of the truck.

The object of the present invention is to develop an unloading device which is situated outside the container interior, and is therefore not exposed to damage by the contents, and at the same time is simple to operate. This unloading facility is intended to be suitable in particular for railway hopper trucks with a longitudinal center sill, and should allow unloading on both sides of the rails. Furthermore, the disadvantages exhibited by known unloading facilities should be avoided.

SUMMARY OF THE INVENTION

The foregoing object is achieved by way of the invention. Wherein at least two flaps are connected via a ridging beam, an axle or the like in the container interior under which beam or axle a rotatable shaft or the like is provided and such that the rotation of the shaft can be transmitted to the flaps.

With this arrangement the outward movement of the flaps is effected via the shaft which is protected from the bulk material both during the loading and unloading of the container.

The length of the shaft is preferably the same as the length of the flaps and features at specific intervals of length flanges and flange pairs on opposite sides of and transverse to the longitudinal axis of the shaft. The flanges accommodate an elbow lever with the help of a push-fit bolt or the like, and the flange pairs a lever also with the help of a bolt or the like; the elbow lever and lever are hinged at the other ends to the flaps. By simple rotation of the shaft about its longitudinal axis the flaps are brought out of their closed position into the open position. The design of the elbow lever and lever on the opposite side is such to bring about the required movement. For this reason the flange pieces connecting up with the elbow lever are shorter than the flange pair holding the other lever.

One version of the device according to the invention is such that the shaft is situated below an axle, the flaps can be turned with the axle via flanges, and projections on the flaps extend over the axle. This has the result of forming one single, roof-shaped run-off surface over which the loose bulk material slides. The projections on the flaps preferably overlap one another when the unloading device is in the closed position, the edge of the upper projection coming to rest on the lower projection, thus preventing the bulk material from trickling onto the axle or shaft.

A preferred version is such that the shaft has its bearings in a hollow section which is attached to the riding beam. The flaps are likewise joined to the ridging beam via hinges. In this case the hollow section must feature recesses to accommodate the flange and the elbow lever when the shaft is rotated.

In accordance with the present invention, a lock is provided between the elbow lever and the flap and between the corresponding lever and other flap. The lock engages in the closed position on a latching device which is mounted securely on a rigid part of the container, for example on the sidewall. Consequently the pressure due to the contents of the container need not be borne by the flaps alone, but is transmitted via the locking mechanism to other parts of the container. Furthermore, the unlocking and the opening of the flaps takes place via only one movement viz., the rotation of the shaft about its longitudinal axis. Special unlocking or, after unloading the truck, locking the flaps in place is not required.

The lock is preferably accommodated in a housing which is securely bolted to the flaps. To this end, for example, undercut grooves are provided on the flaps and serve to accommodate either the head of a bolt or a nut. If worn excessively, the whole locking device can therefore be readily moved and replaced.

The housing surrounds the lock which features rolls with which the lock is braced against a roof on the housing. The rolls assist with the movement of the lock. Provided in the lock itself is an opening which accommodates a means of energy storage, preferably a helical spring which is braced at one end near the latching device against a stop wall fixed to a lower part of the housing and at the other end against a strut in the lock. This means of energy storage is arranged such that the lock is moved into the locking position against the force this provides that is the means of energy storage assists the unlocking. This has been found advantageous as, when the flaps are in the closed, locked position, the whole load from the contents of the container is acting on the flaps and therefore the lock—which makes it more difficult to withdraw the lock from the latching device. On locking the flaps in place after emptying the truck the turning moment of the shaft need only overcome the force produced by the energy storage means.

At the end towards the latching device the lock is shaped as a tongue or latch. The latching device itself comprises a load-bearing section with a roll mounted between its parts. In the closed, locked position the latch engages on the roll.

The load-bearing latching section is secured to a rigid part of the container, for example to a sidewall.

The turning of the shaft can be made manually. Preferably, however, the shaft is provided with a drive unit which, for example, comprises a hydraulic or pneumatic cylinder-piston system. The drive unit is coupled via a connecting rod to a bearing eccentric to the axis of the shaft in a lever arm, and is mounted on a part of the container. Provided only one shaft has to be moved, then the described cylinder-piston system is adequate, the piston rod acting at the same time as the connecting rod. If, for example, two shafts have to be turned, these are connected eccentrically via a connecting rod which is preferably coupled to the cylinder-piston system via a connecting rod with bearing pins in a force transmitting section. It is of course also within the scope of the invention to employ in place of the connecting rod other connecting means such as a cable of chain drive.

This unloading device should preferably find application in a railway hopper truck with center sill at the longitudinal axis of the truck. In such a case the ridging beams or flap axles are arranged on both sides of and parallel to the center sill; from each of these a flap is mounted pointing to the center sill while each of the corresponding other flaps closes against an edge of a section connected to the lower sidewall section. The flap pointing towards the center sill closes against the lower edge of a box section which is mounted onto the center sill; an arm of the said box section extends over the foot of the center sill to form a run-off surface on which the contents of the container slide. With this arrangement the supporting sections for the rolls, both on the base section and on the box section, are situated close to the relevant closing edge of the corresponding flap.

A shaft is appointed to each ridging beam or flap axle, the said shafts being jointly moveable by the connecting rod from the drive unit. As such the drive unit can be situated at either end of the truck. It is however preferably situated at the center of the truck transverse to the long axis of the truck. this way, together with the center sill, it divides the truck into four emptying sections each with an unloading device. The drive unit has therefore also four shafts to turn. Pairs of parallel shafts were therefore each connected by one connecting rod so that two connecting rods enclose the drive unit. The drive unit pivots on its bearing pin between the two connecting rods while the piston thrusts into a sleeve which is in turn hinged to a tongue fixed to the center sill. This way excessive torsional forces acting on the shaft are avoided. It suffices to have one single drive unit to open and close all four unloading devices.

This device is exceptionally simple, not expensive, and constructed such that it is not prone to breaking down. The unloading takes place on both sides of the rails. Particularly attractive is the unlocking—and—opening as well as the closing—and—locking of the flaps which are effected simply by means of counter turning movements of the shaft.

Further advantages, features and details of the invention are revealed in the following description of preferred exemplified embodiments and with the help of the drawings viz.

DETAILED DESCRIPTION

Figure 1:
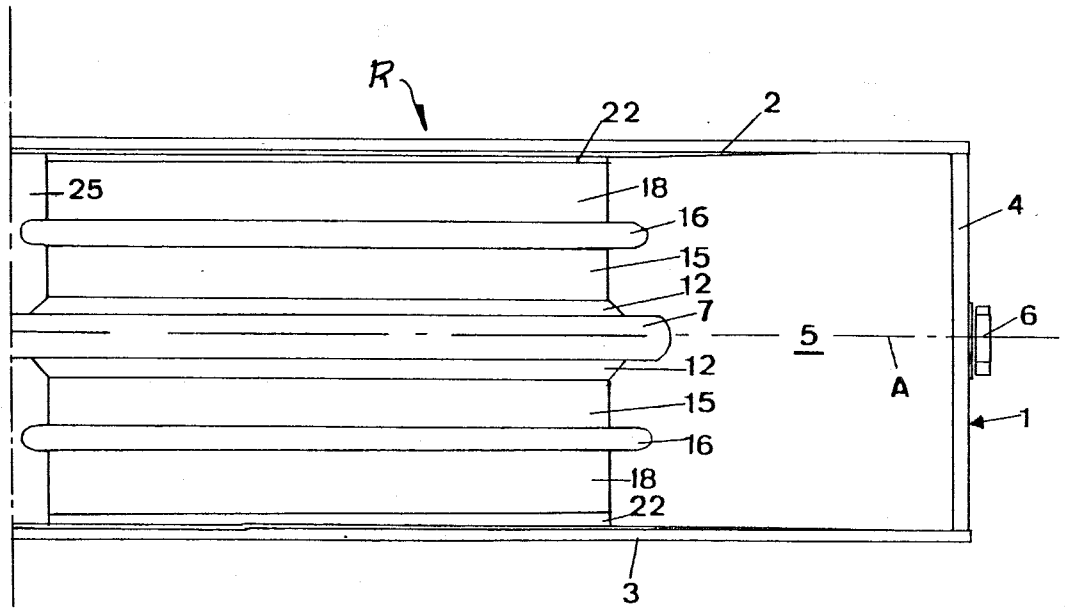
FIG. 1: A schematic plan view of an open railway truck, cut off at the middle here, and designed in particular to transport loose bulk goods.

As shown in FIG. 1, a railway truck R, in particular a railway truck for holding bulk goods, features end walls 1 and sidewalls 2 and 3. An inclined plate 5 slopes towards the interior of the truck from an upper edge 4 of end wall 1; sectioned lengthwise this gives the truck interior the appearance of a silo. The end wall 1 projects over a longitudinal center sill 6 which accommodates coupling facilities, not shown. The center sill 6 runs the whole length of the truck R along axis A and is covered over inside the truck by a hooding section 7 (see FIG. 3). Projecting out approximately perpendicularly on each side of the center sill 6 is a foot 9 to which a box section 10 is attached; the box section 10 features internal, reinforcing ribs 11 and an extension to one side 8 which engages over foot 9 and butts on to center sill 6 to form an inclined run-off surface 12.

Contacting a lower part 14 of the box section 10 is a flap 15 which is hinged to a ridging beam 16 running parallel to the longitudinal axis A. Likewise, hinged to the other side of the ridging beam 16 is another flap 18 which contacts an edge 19 of a section 21 featurig reinforcing ribs 20. A wall plate 22 is connected to section 21 and a lower sidewall beam 23 which terminates the lower end of the sidewall 2 or 3. The flaps 15,18 feature a network of internal strengthening ribs.

Figure 2:
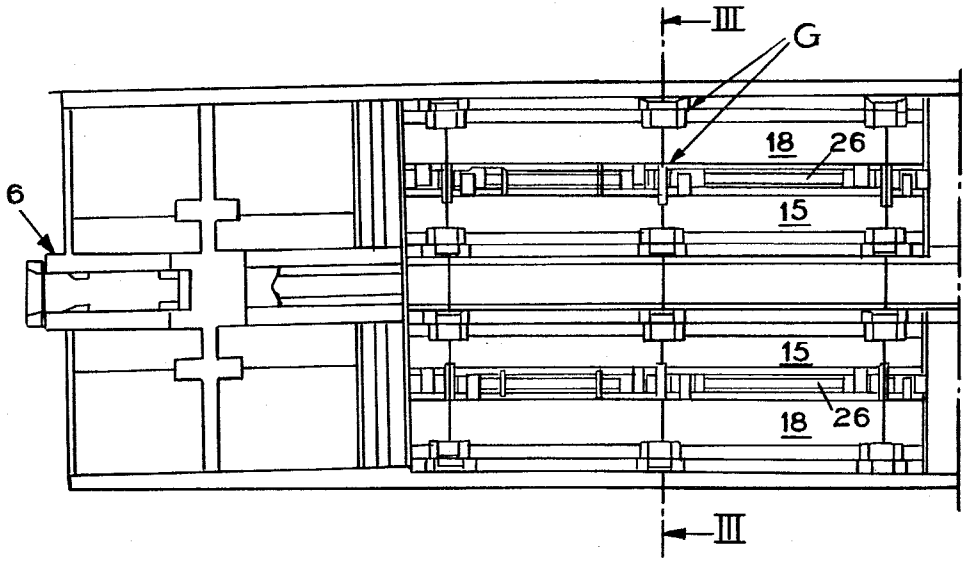
FIG. 2: A schematic plan view of the underside of the part of the railway truck shown in FIG. 1, but not showing a drive unit for the unloading flaps.
Figure 7:
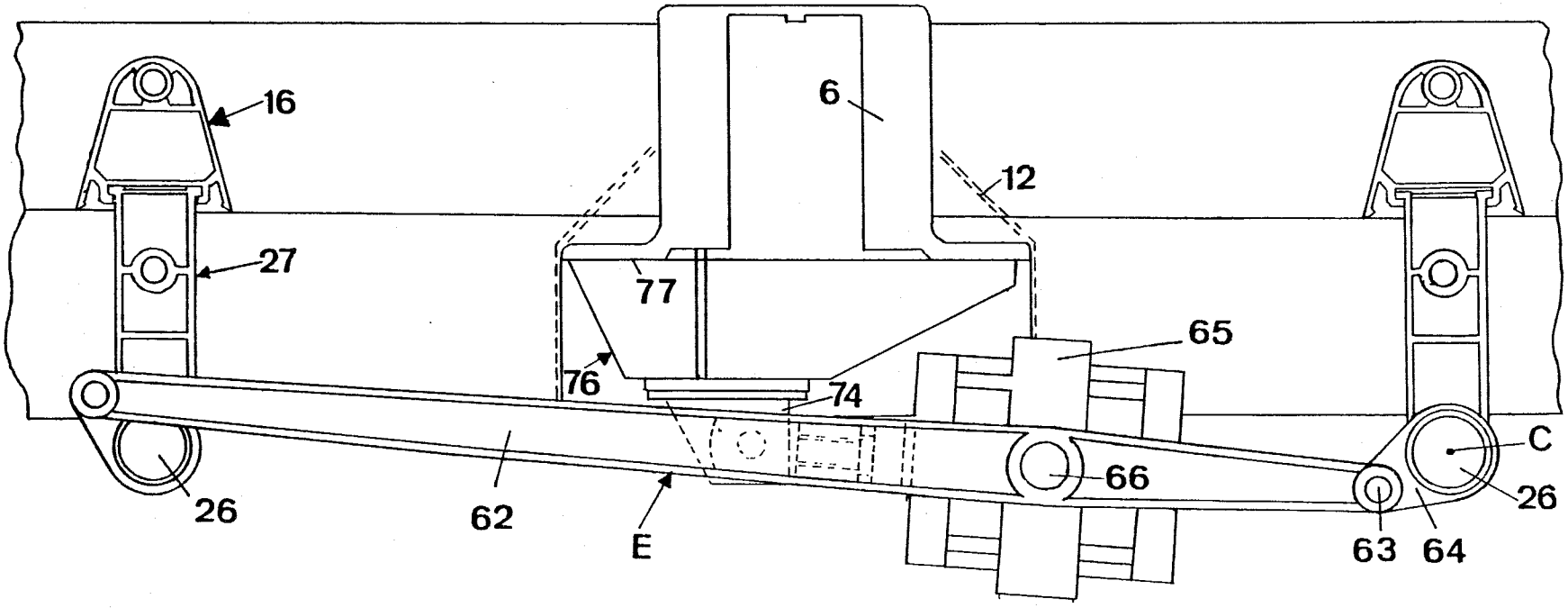
FIG. 7: A view of a drive unit for an unloading flap, looking in the direction of the longitudinal axis of a rail truck.
Figure 8:
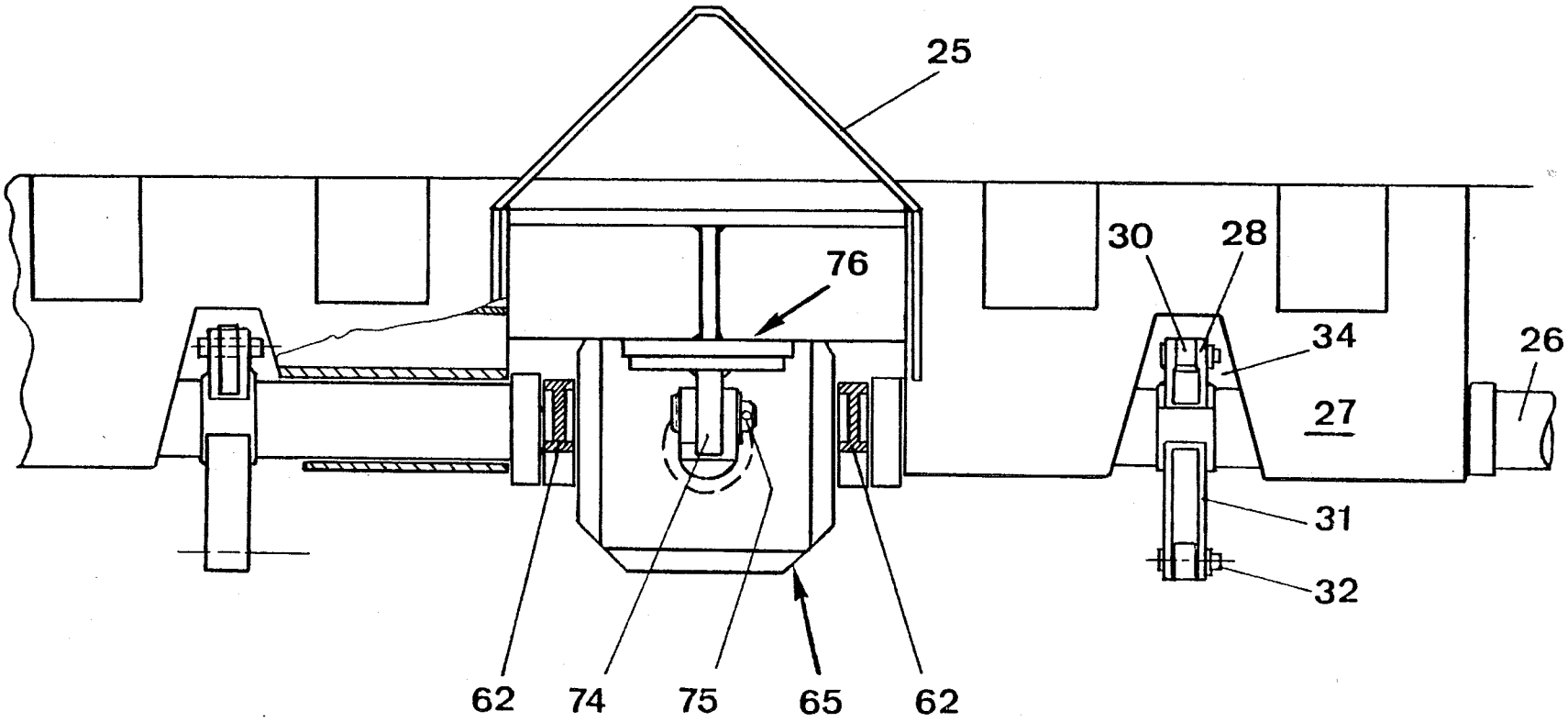
FIG. 8: A partly sectioned view of the drive unit in FIG. 7, looking along a transverse axis of the truck.
Figure 9:
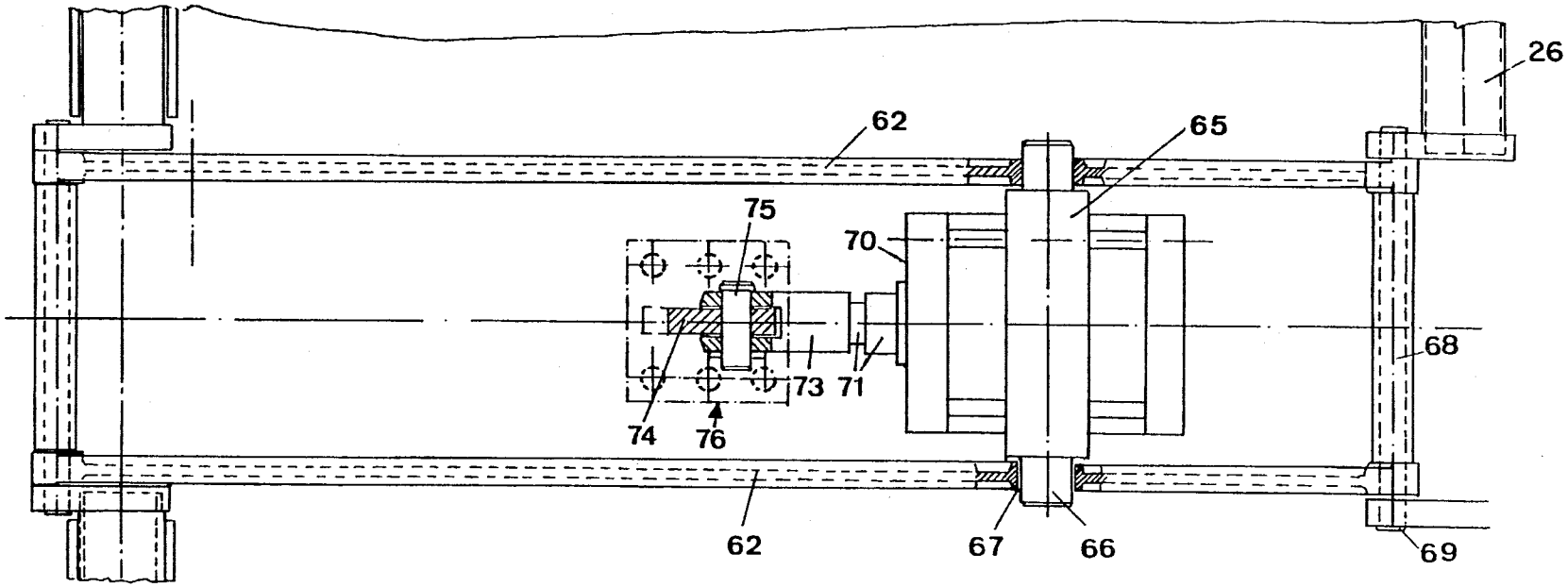
FIG. 9: The drive unit in FIG. 7 viewed from below.

At the middle of the truck R, running transverse to the longitudinal axis A, is a roof-shaped section 25 (see FIG. 8) which is penetrated by the center sill 6, but at which the ridging beam 16 terminates. This roof-shaped section 25 covers over a drive unit E (see FIG. 7) for the flaps 15 and 18 which is also covered over towards the underside of the truck (see FIG. 2). Drive unit E actuates on both sides of it rotatable shafts 26 mounted on the ridging beam 16; these rotatable shafts 26 in turn actuate unlocking units G.

Figure 3:
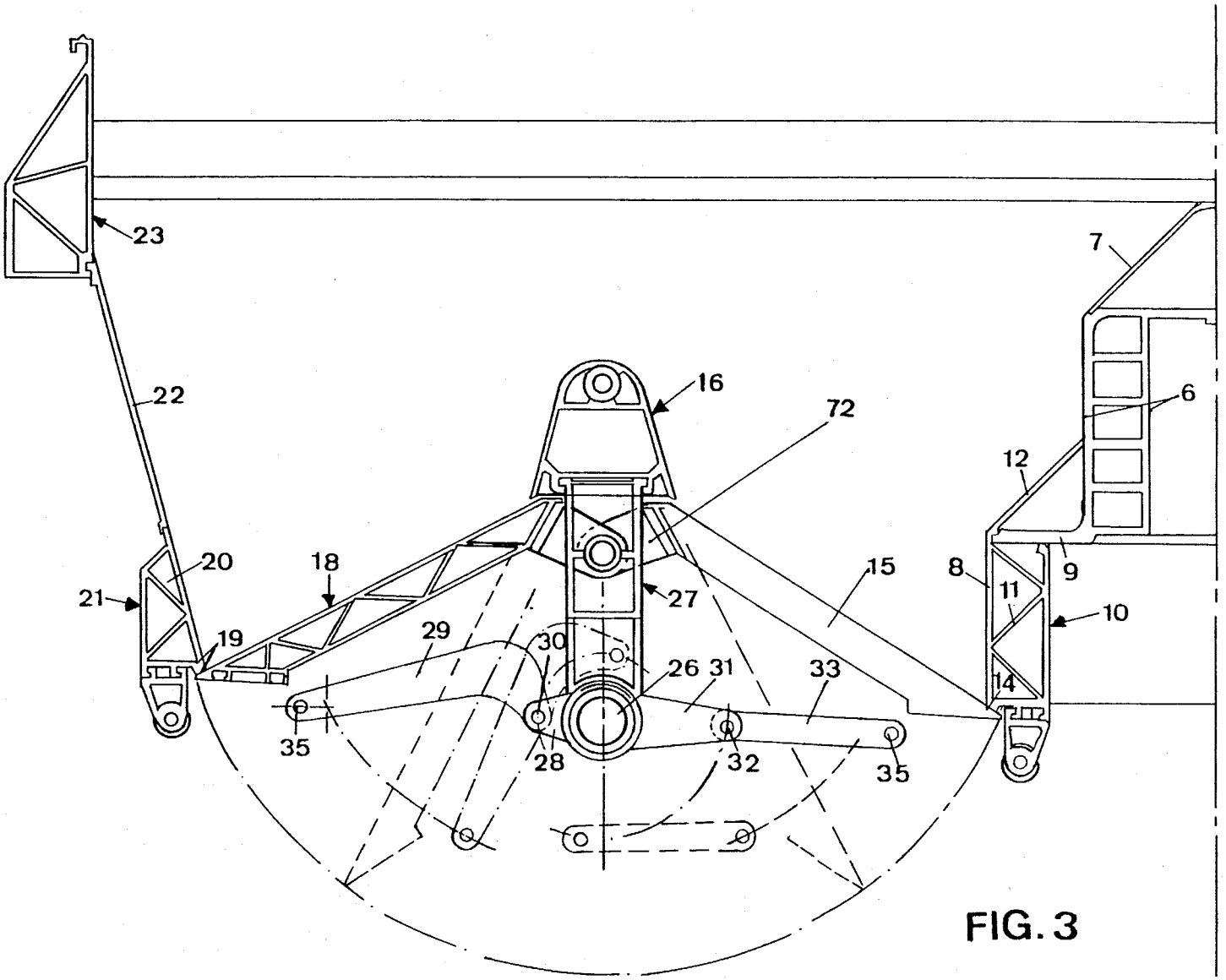
FIG. 3: An enlarged cross section along line III—III in FIG. 2, but not showing locking elements.

As shown in FIG. 3, shaft 26 is mounted on and turns in a reinforced hollow section 27 mounted below the ridging beam 16. Formed onto shaft 26, perpendicular to its longitudinal axis B and spaced a certain distance apart, are flanges which are such that an elbow lever 29 is accommodated between two flanges 28 and hinged there by means of a push-fit bolt 30, while another pair of flanges 31 extending from the other side of the shaft 26 likewise accommodate a lever 33 hinged on a bolt 32. This arrangement is such that the distance a from bolt 30 to axis B is smaller than the distance b from bolt 32 to axis B (see FIG. 4). As a result the elbow lever 29, partly together with the flanges 28, can be retracted into a recess 34 in hollow section 27 (FIG. 8, but for reasons of clarity shown here without elbow lever 29 and lever 33), and can so without hindering the opening of the flaps 15 and 18. The position of flaps 15 and 18 when open and the corresponding positions of the flanges 28, elbow lever 29, flange pair 31 and lever 33 are shown by broken lines in FIG. 3.

Figure 5:
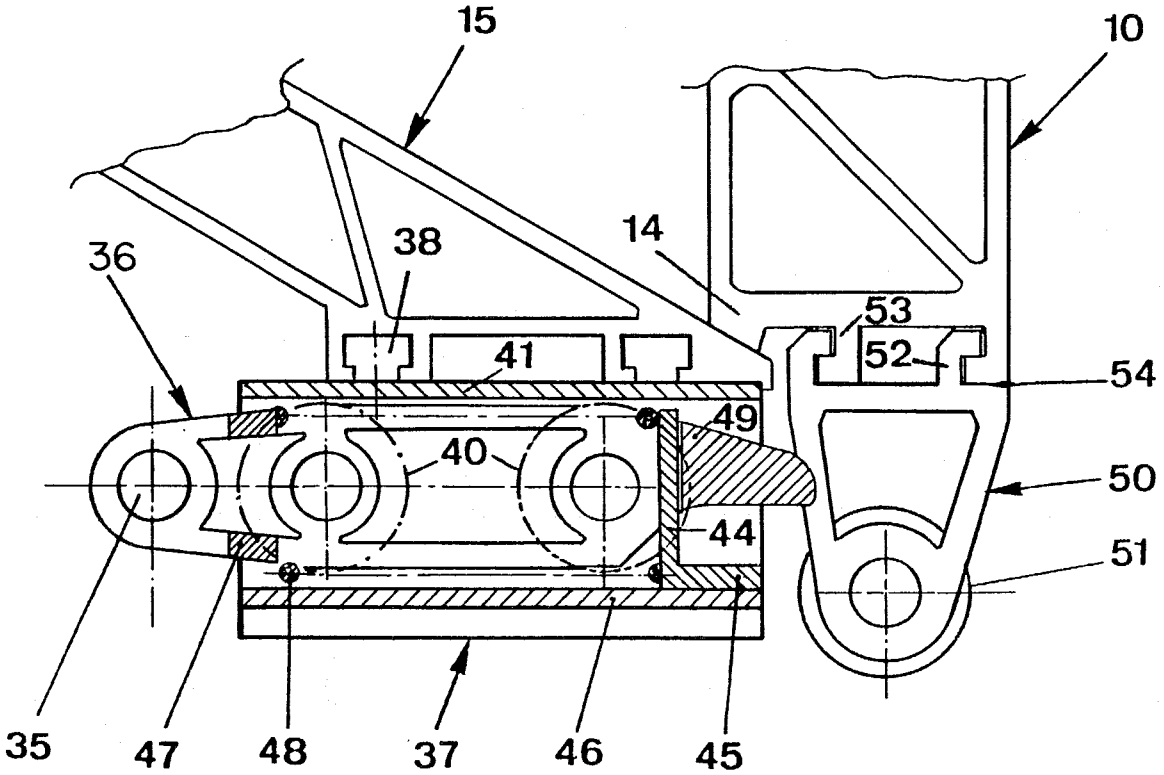
FIG. 5: A cross section through a locking element.
Figure 6:
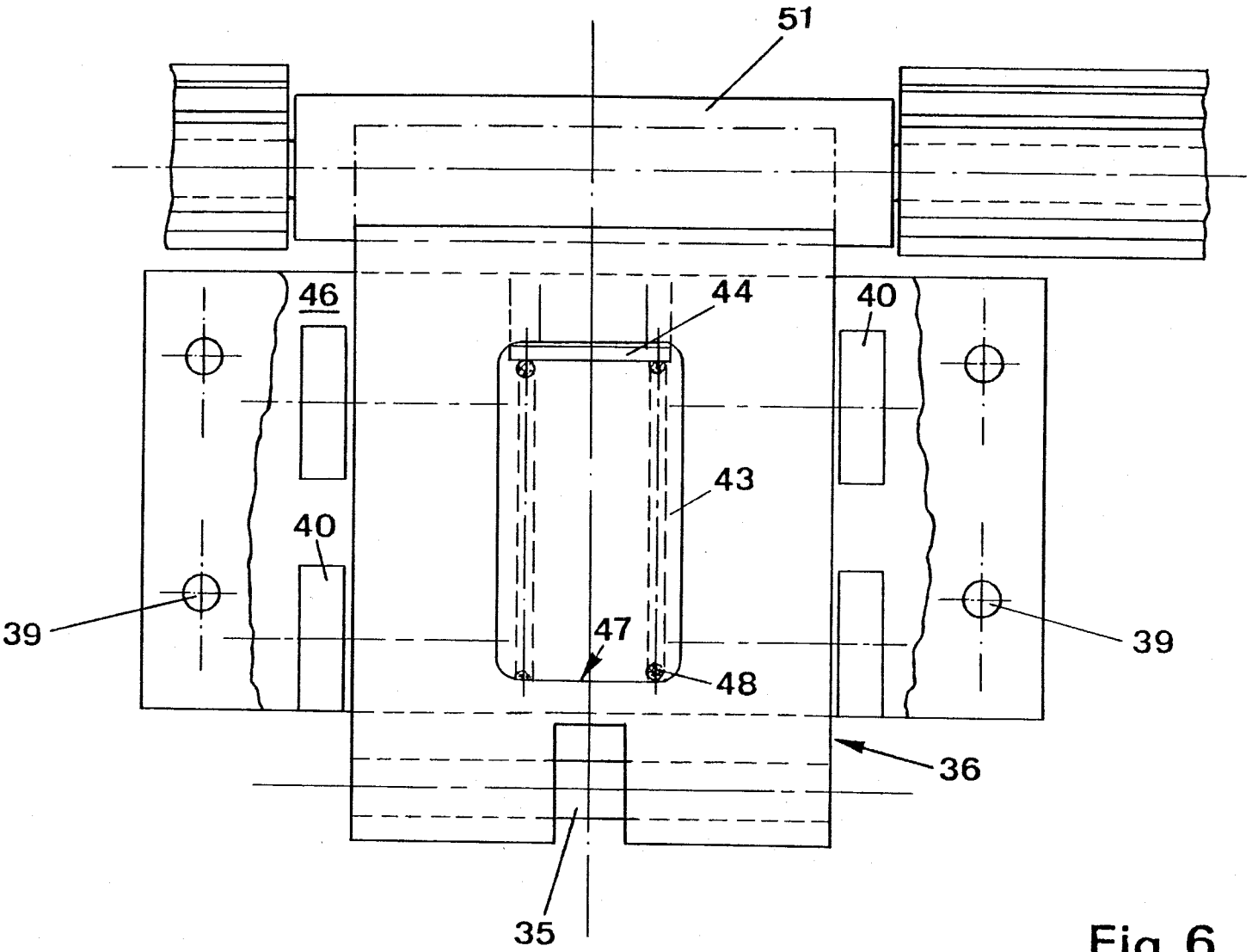
FIG. 6: A partial plan view of the locking element shown in FIG. 5.

A locking device 36 is hinged via bolts 35 at the ends of the elbow lever 29 and lever 33 away from the bolts 30 and 32 respectively. For reasons of clarity this locking device is shown in FIGS. 5 and 6 in particular in the version employed at one of the flaps 15 contacting box section 10. The same locking device holds the flap 18 in place against the supporting section 21.

The locking device 36 is situated in a housing 37 which is connected to the flap via bolted connections (not shown here) engaging in undercut grooves 38 on the lower face of the flap. The holes 39 for these bolts are shown in FIG. 6.

The locking device 36 features rollers 40 which are in contact with roof 41 of housing 37. At about the middle roof 41 features an opening 43 that engages a wall 44 which rests on the lower part 46 of the housing 37 via a foot 45. In the opening 43 is a helical spring 48 which is braced against the stop wall 44 and against a strut 47; in the open position of the locking device 36 shown here the said spring 48 is relaxed. This helical spring 48 helps to transmit the turning moment of the shaft 26 to the lock 36 in order to open the lock when unloading the truck R.

The locking device 36 projects out beyond the stop wall 44 as a latch 49 which is part of the housing 37. Facing this is a roll 51 in a supporting section 50 on box section 10. The supporting section 50 is engaged to the box section 10 via hooks 52 in corresponding recesses 53 and welded securely into place by weld bead 54. When the flap is in the closed position, the latch 49 engages on the roll 51, at the same time countering the pressure of the helical spring 48.

Figure 4:
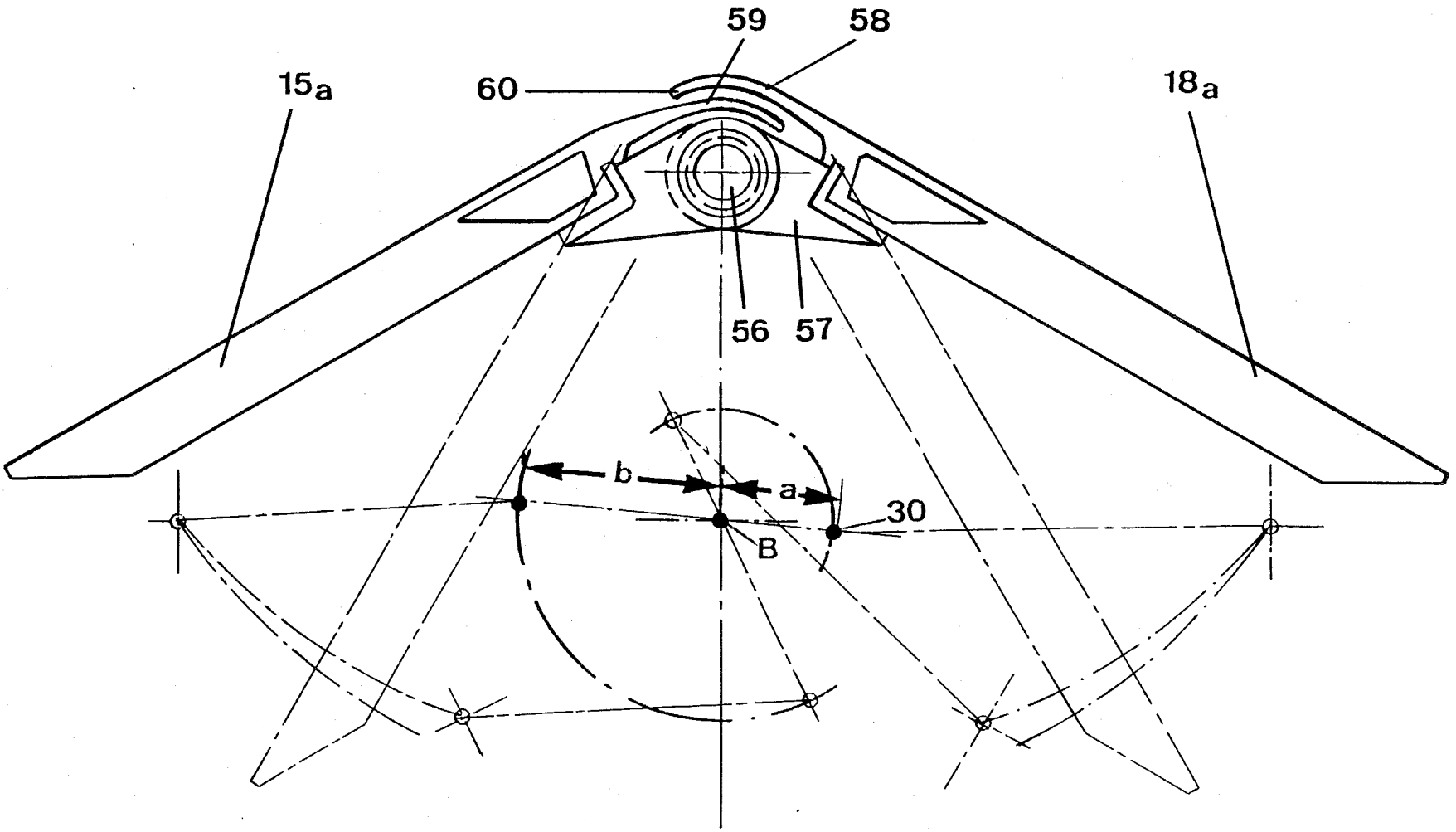
FIG. 4: Another, mirror-imaged version of that shown in FIG. 3, but enlarged and highly schematic.

The flaps 15 and 18 are, as shown in FIG. 3, normally hinged below ridging beam 16 via hinges 72. Another exemplified embodiment, shown in FIG. 4, is such that a ridging beam is no longer necessary. This is made up of two flaps **15*a* and 18*a* which rotate on flanges 57 about an axle 56 and feature projections 58 and 59 which extend over the axle 56. The projections 58 and 59 overlap each other also when the flaps 15*a* and 18*a* are in the open position. In the closed position the leading edge 60 of the upper projection 58 touches the lower projection 59 thus preventing the loose contents from trickling through to the axle 56** or out of the truck.

The drive mechanism E is preferably mounted at the middle of the truck transverse to the long axis A and actuates on each side two shafts 26 via connecting rods 62. These connecting rods 62 activate the shaft 26 via lever 64 with bearings 63 lying excentric to axis of rotation C of shaft 26. Between both connecting rods 62 (FIG. 8) is a force transmitting frame 65 with bearing pin 66 in the bearing 67 of the corresponding connecting rod. Furthermore, both rods 62 are connected at the relevant bearing 63 via rods 68 which feature end pins 69 in the bearings 63.

The frame 65 contains a pneumatic cylinder 70 which has a piston 71; the piston 71 is accommodated by a sleeve 73 which, at the end away from the piston 71, engages like a stirrup with a tongue 74 and is attached to the same via bolt 75. The tongue 74 is permanently attached to the frame 76 which is bolted to the lower side 77 of the center sill 6.

The movement of the connecting rod 62 is effected by means of a stroke of the piston 71 in a cylinder 73; this can take place either hydraulically or pneumatically.

Control devices—not shown here—are provided for the drive unit E to limit or reverse the movement of rotation of the shafts 26.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A device for unloading bulk material from a container wherein the floor of the container is made up at least in part of flaps which can be rotated outwards from the interior of the container, the improvement which comprises at least two flaps rotatably mounted on a support frame in the interior of the container, a rotatable shaft mounted under the support frame and operably secured to the flaps such that the rotation of the shaft can be transmitted to the flaps for tilting same, a lock connected to each of the flaps such that one end of each lock is operably connected to the rotatable shaft and the other end of each lock engages in a latching device when the flaps are in the closed position, wherein the latching device is made up of a supporting section mounted on a box section by means of hooks on the supporting section which engage in counterparts in said box section and are held in place by adjoining means, wherein the rotatable shaft is provided with a first pair of flanges and a second pair of opposed flanges on opposite sides of and transverse to the longitudinal axis B of said shaft, said first pair of flanges having an elbow lever rotatably fixed thereto at a point A and said second pair of flanges having a second lever rotatably fixed thereto at a point B wherein the elbow lever is hinged to one of said flaps and the second lever is hinged to the other of said flaps, wherein the distance between point A and longitudinal axis B of said shaft is smaller than the distance between point B and the longitudinal axis B of said shaft, wherein connected to each of the flaps is a said lock, each lock is connected at one end by a bolt to the respective elbow lever or second lever, and at the other end, in the closed position, engages in a said latching device, wherein each lock is situated in a housing which is secured to the flaps such that the lock is braced via rolls on one side against the roof of the housing and on the other side against the lower side of the housing, wherein each lock features a hole which accommodates means for energy storage, said means for energy storage has one end braced against a stop wall which rests on the lower side of the housing and another end braced against a strut, and wherein each lock is shaped in the form of a latch which projects towards the latching device wherein the supporting section features a roll on which the latch engages in the closed position.

2. A device according to claim 1 wherein said flaps are provided with overlapping projections which cover the support frame at least when the flaps are in the closed position.

3. A device according to claim 1 wherein the shaft is rotatably mounted in a hollow section which is securely attached to the support frame and the hollow section is provided with recesses which receive the first pair of flanges and the elbow lever.

4. A device according to claim 1 wherein the shaft is connected to a drive unit comprising a cylinder-piston system which is coupled to the shaft by a linkage system for transmitting motion thereto.

* * * * *